United States Patent [19]

Allspaw

[11] Patent Number: 4,967,948

[45] Date of Patent: Nov. 6, 1990

[54] PALLET BUILDING MACHINE

[75] Inventor: Scott N. Allspaw, West Chester, Ohio

[73] Assignee: Senco Products, Inc., Cincinnati, Ohio

[21] Appl. No.: 262,884

[22] Filed: Oct. 26, 1988

[51] Int. Cl.[5] ..... B27F 7/09

[52] U.S. Cl. ..... 227/152; 227/4; 227/7; 227/50

[58] Field of Search ..... 227/2, 7, 4, 42, 45, 227/50, 44, 39, 40, 152

[56] References Cited

U.S. PATENT DOCUMENTS

| | | | |
|---|---|---|---|
| 3,591,067 | 7/1971 | Vial | 227/4 X |
| 4,403,388 | 9/1983 | Belcher | 227/50 X |
| 4,793,540 | 12/1988 | Mangan et al. | 227/7 |

*Primary Examiner*—Paul A. Bell

*Attorney, Agent, or Firm*—Jerrold J. Litzinger

[57] ABSTRACT

An improved system for continuously producing wood pallets and the like. The system features improved tool mounts for the nailing tools of a pallet machine which are adapted to position the tools for the attachment of pallet pieces using two degrees of freedom; vertical travel and simultaneous rotation about a hinge point to allow accurate delivery of nails and to rotate slightly in the recoil direction as the tool recoils. The system also uses an improved hold down clamp which features a dampening material to contact the unassembled pieces of the pellet within the fixture to absorb vibration and accommodate irregularities in the top boards of the pallet.

9 Claims, 8 Drawing Sheets

PALLET BUILDING MACHINE

BACKGROUND OF THE INVENTION

Wooden pallets are used in great numbers for shipping, storage and handling of a wide variety of products in bulk. Due to heavy loads and rough handling, pallets are frequently destroyed or damaged and generally have a relatively short useful life. A continuous supply of substantial quantities of new replacement pallets is needed in industries which involve bulk storage and handling operations.

The methods of pallet construction have historically ranged from totally manual operations, using simple jig systems, to large, expensive, automated systems which are capable of the continuous production of pallets at automated speed.

One such automated system is disclosed by Mangan and May in U.S. Pat. No. 4,793,540 issued Dec. 27, 1988, now U.S. Pat. No. 4,793,540 and assigned to Accurate Tool, of Dayton, Ohio, which is prior art and hereby incorporated by reference herein. The Accurate system, while providing for rapid and continuous production of wooden pallets, has experienced some operational problems to which the present invention is directed.

One problem experienced by the Accurate system is the failure of its tool mounts to fully accommodate varying wood thicknesses, surface irregularities and the vibration and shock attendant to the operation of the nailing tools. The tool mounts of the Accurate system, being relatively immobile, may be jammed should the tool encounter an obstruction such as an improperly placed nail or other surface irregularity.

The tool mounts of the Accurate system were individually attached to a mounting bridge which was vertically adjustable. However, this did not prove to be effective in avoiding or accommodating the above-described problems.

It is therefore desirable to provide tool mounts for the nailing tools of a pallet system, such as the Accurate system, which are independently capable of accommodating dimensional irregularities in the pallet members, absorbing the shock associated with the operation of the nailing tools, and avoiding and accommodating nail jams and similar problems associated with the feeding of the pallet as it is constructed in such a system.

The continuous pallet building systems of the prior art have generally required that their transport systems make a momentary stop to allow the nailing tools to properly place the nail in the pallet. It is therefore desirable to produce a tool mount/nailing tool arrangement which will allow the nailing operation to be carried out while the transport system is in motion ('on the fly') to increase the efficiency of the machine while obviating the more complex control systems attendant to stop/-start transport systems of the prior art.

Another problem associated with pallet building systems such as the Accurate system is in the alignment and registration of the pallet pieces prior to their being fed past the nailing stations for assembly. A system such as the Accurate system utilized a hold-down clamp of rigid material which was brought into sliding contact with the upper surfaces of the top slat pieces by a vertically actuating piston and cylinder combination. It was the purpose of the hold-down clamp to maintain the position of the yet unattached pallet pieces. The prior art system was undesirable because it encumbered the loading of the pallet parts, did not absorb vibration, and failed to properly move the top deck boards against the locating members.

It is therefore desirable to provide a hold-down clamp for such a pallet system which properly places the top deck boards against the locator members while accommodating surface variations, absorbing vibration, and allowing freer loading of the pallet parts.

SUMMARY OF THE INVENTION

The present invention provides an improved system for continuously producing wooden pallets and the like.

In particular, the present invention provides improved tool mounts for the nailing tools of a pallet machine or like machines for producing similar longitudinal assemblies. The tool mounts of the present invention, which are adapted to position nailing or stapling tools for the attachment of the pallet pieces, have two degrees of freedom. These tool mounts are capable of vertical travel as well as simultaneous rotation about a hinge point so as to allow the delivery end (with nailing tools, the tool guide body) to rotate slightly in the downstream direction as the tool recoils. The tool mounts utilize springs or the mechanical equivalent to maintain the tools in the vertical position, exert counterforce against the vertical and rotational movement of the mount, and dampen vibration. The tool mounts for the upper tools which attach the top slat boards also feature a vertical alignment wheel or its mechanical equivalent to maintain a consistent distance between the tool guide body and the top surface of the top slat to facilitate uniform nail or staple delivery depth while avoiding obstacles which could cause the machine to jam.

The up-and-down travel of the tool mounts is accomplished by a 'floating' style tool mount in accordance with the ensuing description of the invention.

In one embodiment of the invention this is accomPlished by a vertical attachment plate which is attached to the tool and is slidably attached, with counterforce spring means, to a vertical mounting plate which is in turn attached to the machine support structure indirectly through a series of two horizontal plates—a control plate above and a base plate below—with a hinge between the two on the upstream side and a counterspring on the downstream side. This structure allows the delivery end of the tool to rotate slightly downstream upon recoil of the nailing or stapling tool.

In short, the present invention approximates the important movements which would be made if the tool were fired by hand. That is, it provides a method of nail placement which avoids all of the problems attendant to rigid fixation of the nailing tool in the tool mount. The ability of the upper tool mount to move vertically to permit the tool to ride over the surface of the top slat pallet pieces avoids jamming, accommodates irregularities in the pallet Pieces, and controls nail or staple depth. The ability of both upper and lower tool mounts to move both vertically and rotate downstream with tool recoil also helps facilitate continuous assembly while the transport system is in motion and aids in better nail placement by allowing the tool guide body to follow each attachment pint downstream as the tool is fired. The combination of the counterspring means for both the vertical and rotational movement maintain and return the tool to its firing position while giving the additional benefit of dampening vibration throughout the machine.

The present invention also provides an improved hold-down clamp for the yet unattached pieces of the pallet or the like, which features at least one facing surface of a dampening material, such as a brush, which holds the pallet pieces or the like in place against the locating jig members in the alignment bed while absorbing vibration from the loose boards and accommodating irregularities in the top boards of the pallet or similar longitudinal assembly. The hold-down clamp also serves to supply some counterforce upstream against the downstream movement of the unassembled pieces in the alignment bed so as to aid in positioning the pieces prior to their being attached. The pieces are thereby urged upstream against the downstream-moving jig members to give more secure and precise positioning of the pieces in their final position.

The dampening material, such as a brush-like material or its mechanical equivalent, is mounted onto a hinged clamp which is in turn movably mounted to an appropriate portion of the machine frame so that it can be raised for placement of the pieces of the pallet or the like in the alignment bed. The frame is then lowered so as to place the dampening material into frictional contact with the top pieces of the assembly in its final position. The unattached assembly is then moved by the nailing station(s) for assembly. The hold-down clamp mounting comprises preferably pneumatic adjustment means to raise and lower the holding surface of the hold-down clamp.

The present invention, while described herein in its application to pallet construction, is not so limited and may be applied to the formation of various matrices such as fencing or latticework. For different applications, it may be desirable to use nailing or stapling tools from above, from below, or from both above and below the unassembled pieces.

DETAILED DESCRIPTION OF THE PREFERRED EMBODIMENT

Figure 1:
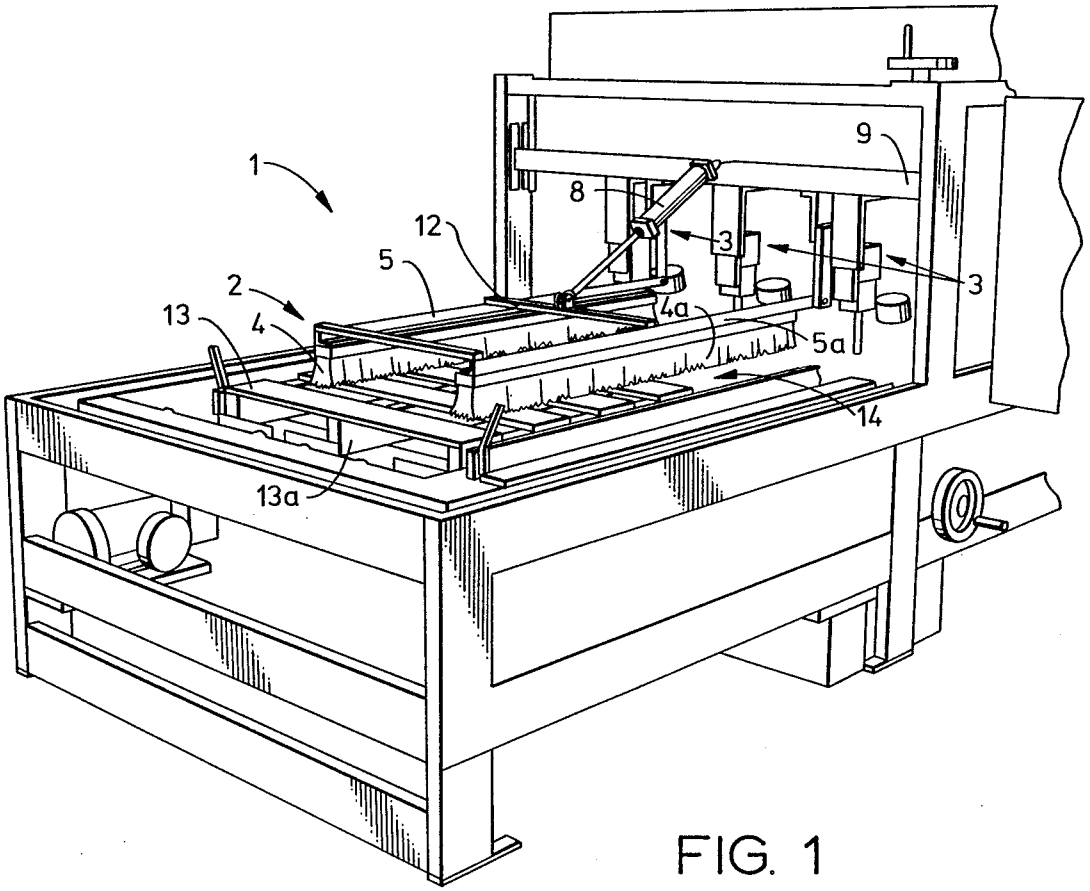
FIG. 1 is a fragmentary perspective view of the alignment bed portion of a pallet building system apparatus to which the improvements of the present invention may be applied and showing the one embodiment of the hold-down clamp of the present invention. The top nailing tools are visible in the downstream portion of this view.

FIG. 1 shows a perspective view of the pallet piece loading portion of a pallet building machine 1 having an alignment bed 14 which contains a jig system for aligning the pallet pieces in their final position in preparation for assembly into a finished pallet. This view shows the inventive hold-down clamp 2 and inventive tool mounts 3. The balance of the pallet building machine downstream beyond the tool mounts 3 is not shown.

Figure 2:
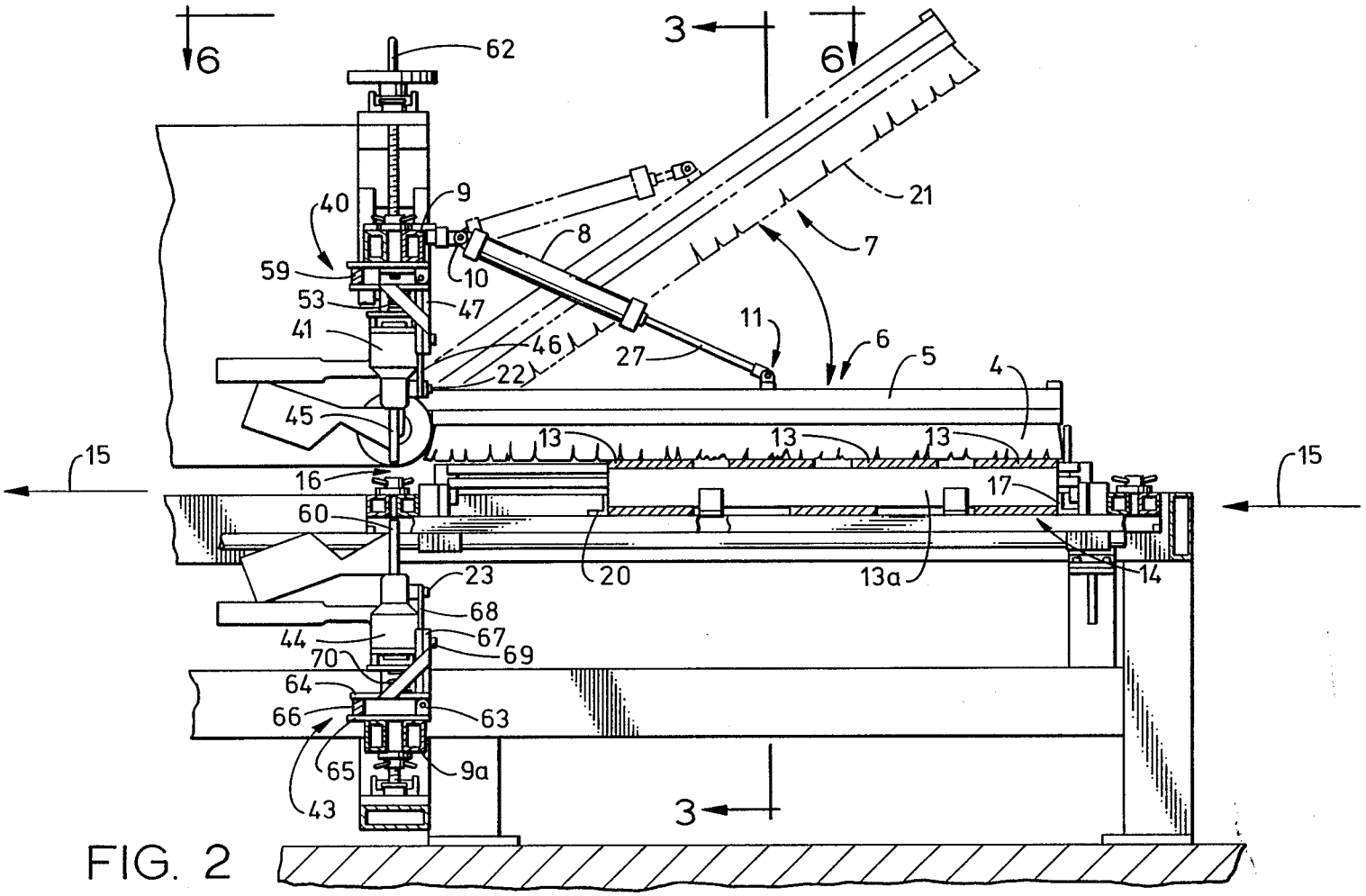
FIG. 2 is an elevational view of the alignment bed and nailing station of the present invention.

FIG. 2 shows a side elevational view of a Preferred embodiment of the present invention. As can be seen in FIGS. 1 and 2, the hold-down clamp assembly contains dampening, brush-like material 4 and 4*a*. held respectively on bridges 5 and 5*a*, which in turn are moveable from a lower position 6 to an upper position 7 and vice versa by moving means. In the displayed embodiment, such moving means comprise a pneumatic lift 8 which is attached to the horizontal support structure 9 at support hinge 10 and attached, via bridge hinge 11, to cross member 12 which in turn is attached to bridge members 5 and 5*a*. By action of the pneumatic lift 8, the clamp assembly 2 can be raised in drawbridge fashion so as to bring the bridge to a height sufficient to allow workmen comfortably to place pallet pieces, such as top slats 13 and stringers 13*a*, in alignment bed 14, as in uppermost position 7 shown in FIG. 2. The clamp assembly 2 can then be lowered to place the dampening material 4 in firm and resilient contact with the pallet pieces in the alignment bed. The height of the dampening material in its lowered position 6 is controlled by the cooperation of the extent of actuation of the pneumatic lift 8 and the height of the base hinge 25 which is controlled by moving the adjustable leg 26 with respect to support extension 27 by action of adjustment bolts 28 in slot 35. The position of the clamp assembly 2 in the lowermost position 6 is adjusted so as to place the dampening material 4 in firm and resilient contact with the top pallet slats 13. Such firm and resilient contact is intended to mean contact which maintains the pallet pieces in their proper final positions (i.e., the positions they will ultimately occupy in the finished pallet) in the alignment bed, while allowing the movement of said pallet pieces in the downstream direction 15 toward the nailing positions 16 and supplying an upstream counterforce which is overcome by the downstream movement of the pallet pieces in the alignment bed. Such contact aids in the proper positioning of the pallet pieces in the jig system comprising jig pieces such as 17, 18, 19 and 20 in the alignment bed 14. Firm and resilient contact is generally achieved in the displayed embodiment when the top pallet slat pieces 13 extend into the surface 21 of the dampening material 4. It is preferred that the dampening material extend downstream to a point just before the pallet pieces encounter the nailing station as can be seen in FIG. 2. This helps secure the pieces of the pallet right up to the point where they are assembled at the nailing station.

Figure 3:
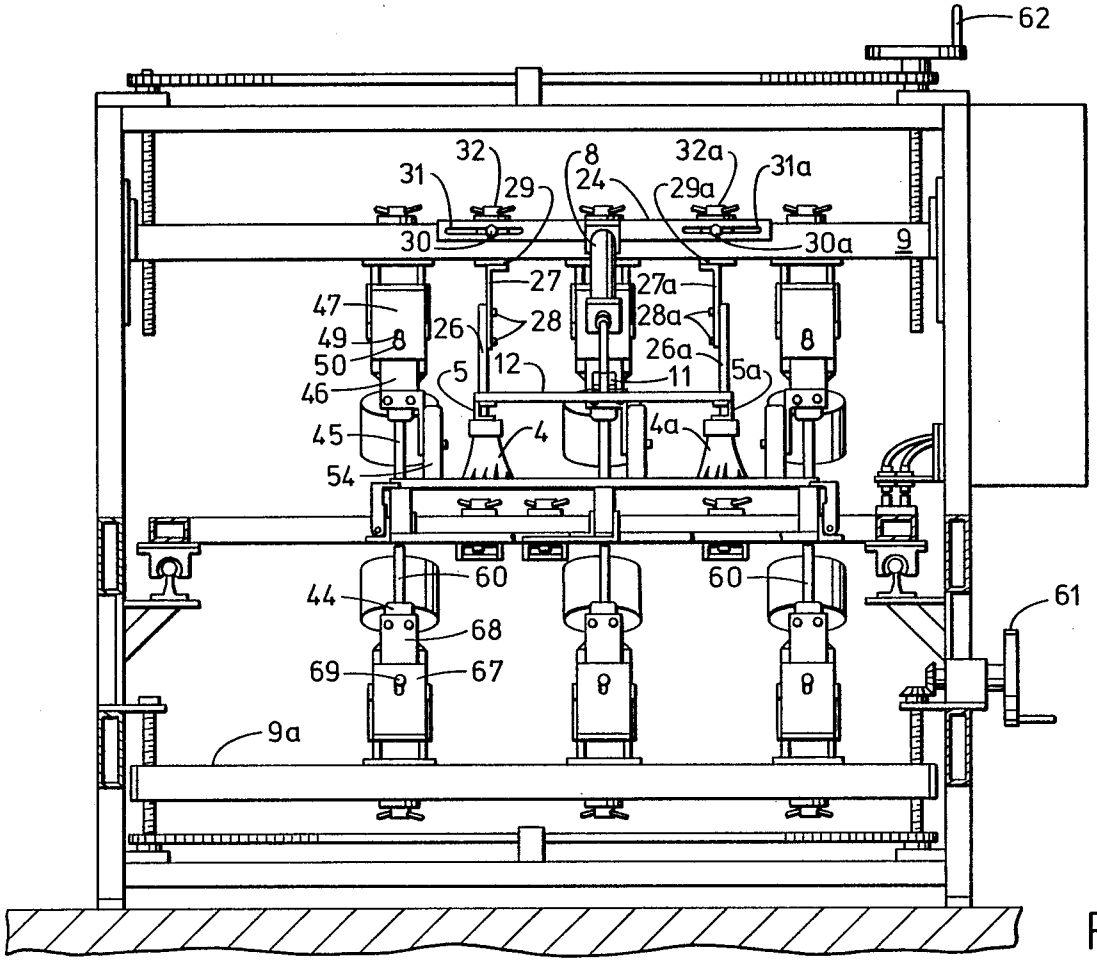
FIG. 3 is a cross-sectional view taken along line 3—3 of FIG. 2.
Figure 7:
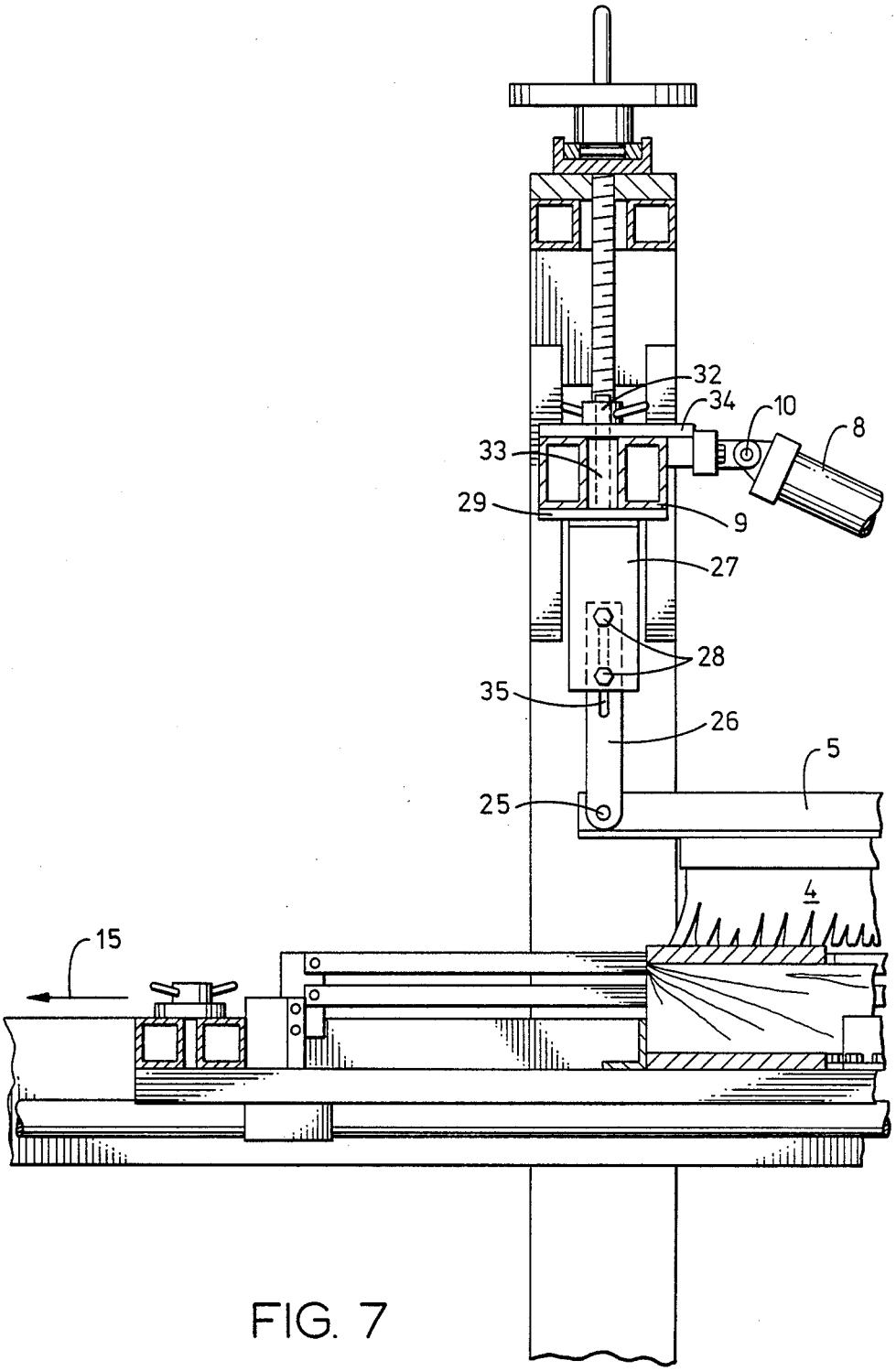
FIG. 7 is an elevational, cross-sectional view, in the downstream direction, of the hold-down clamp assembly of the present invention.

Another view of the clamp assembly is shown in FIG. 3 which is a downstream view of a longitudinal section as shown in FIG. 2. This view shows the dual nature of the base hinge height adjustment for bridges 5 and 5*a*. The clamp assembly can be adjusted horizontally by moving bottom base plates 29 and 29*a* (to which support extensions 27 and 27*a* are attached respectively). This is accomplished by adjusting the position of positioning bolts 30 and 30*a* in slots 31 and 31*a*, respectively, which are contained in overlap piece 24 attached to horizontal support member 9. As seen in FIG. 7, the adjustment is maintained by tightening hand nut 32 on threaded bolt 33 which extends vertically from the upper surface of bottom base plate 29 between the two beams of the horizontal support member 9 and further through top base plate 34. A like structure exists for the adjustment of base plate 29*a*, although this is not shown in the drawings.

Figure 4:
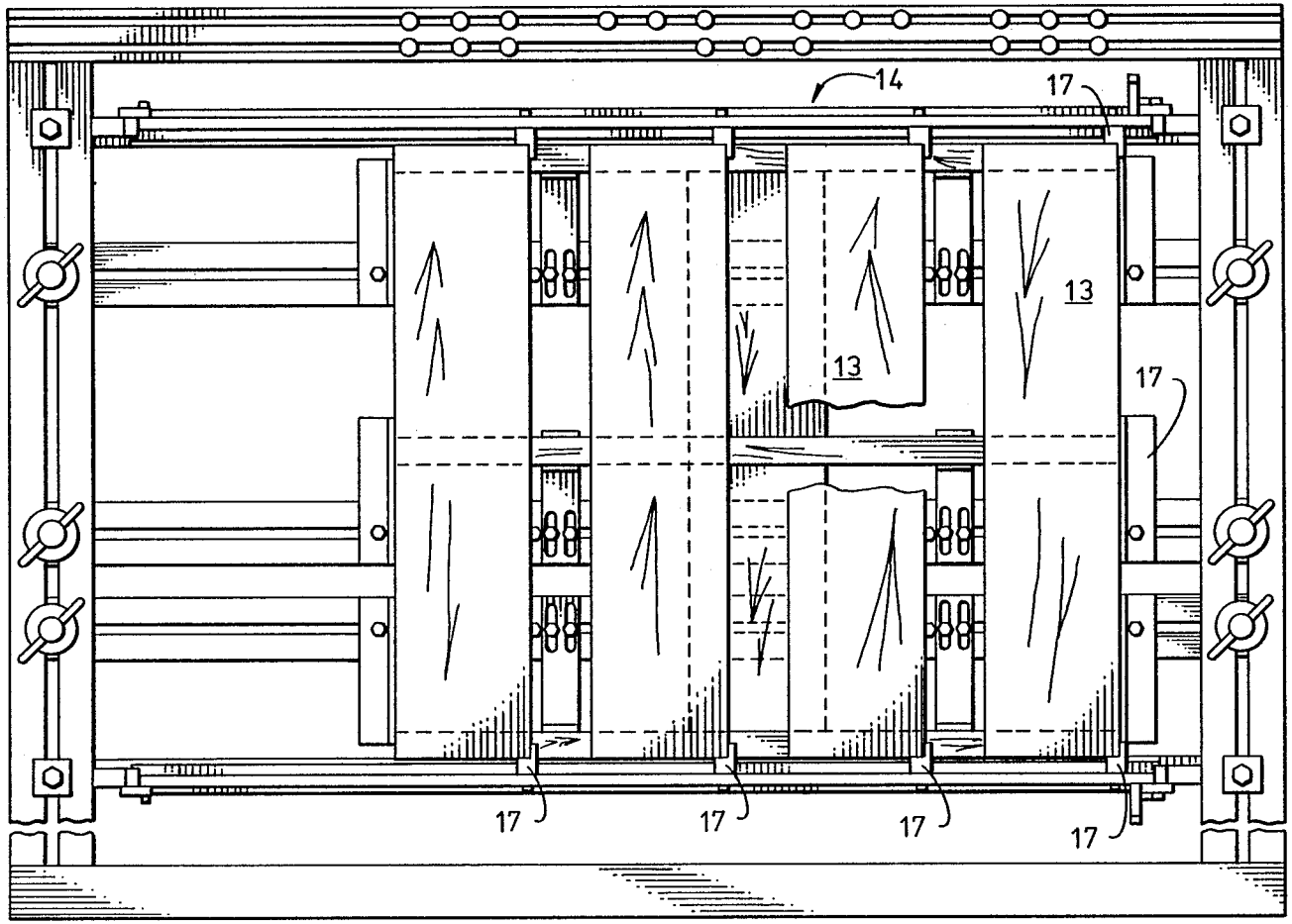
FIG. 4 is a plan view showing a typical alignment bed and fixture for receiving slats and stringers with individual bottom slat bounds broken away for clarity.
Figure 5:
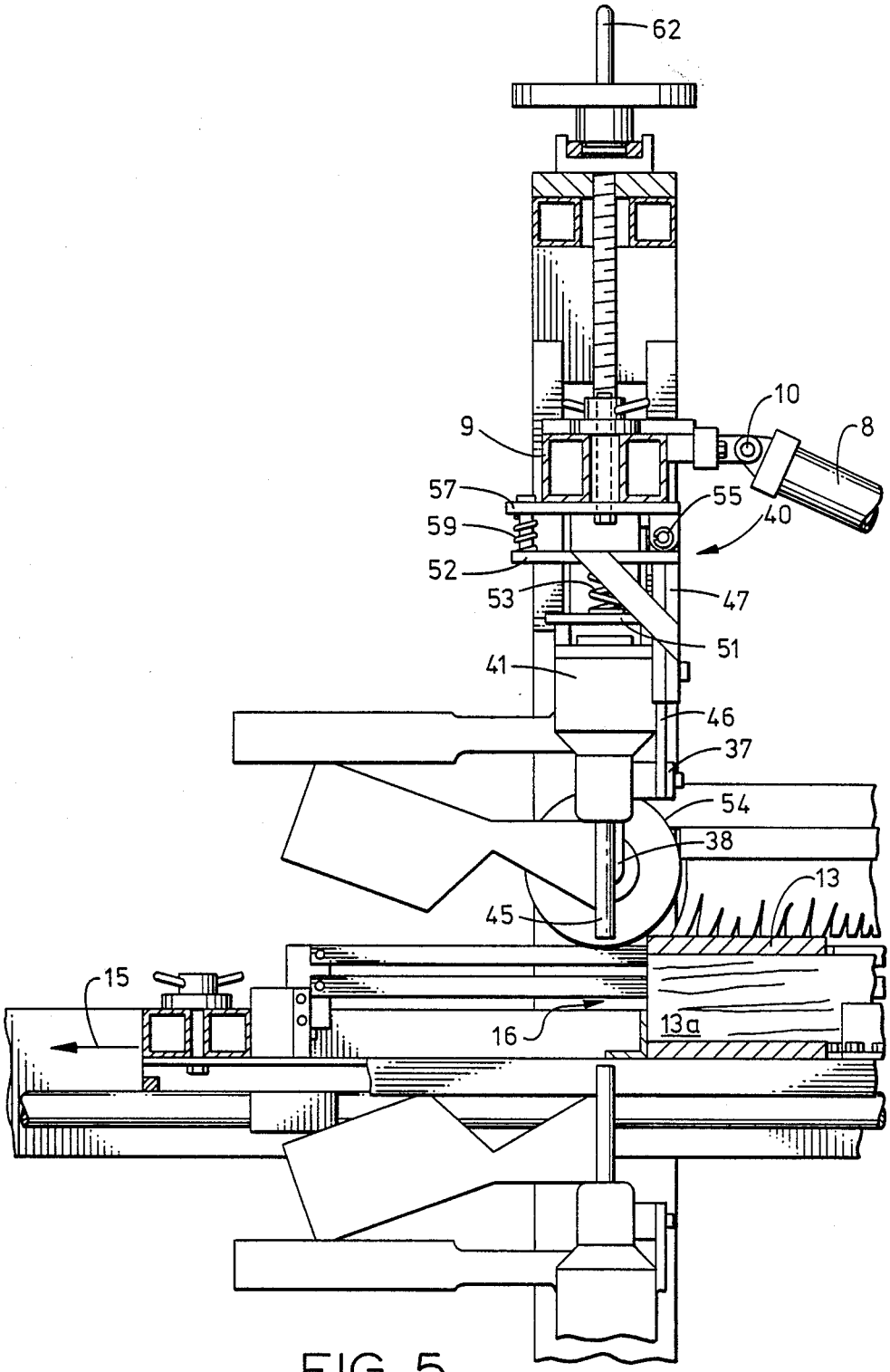
FIG. 5 is an elevational view of the nailing station including top nailing tool and tool mounting assembly of the present invention. The top portion of the bottom nailing tool is also shown with pallet pieces entering the nailing position.
Figure 6:
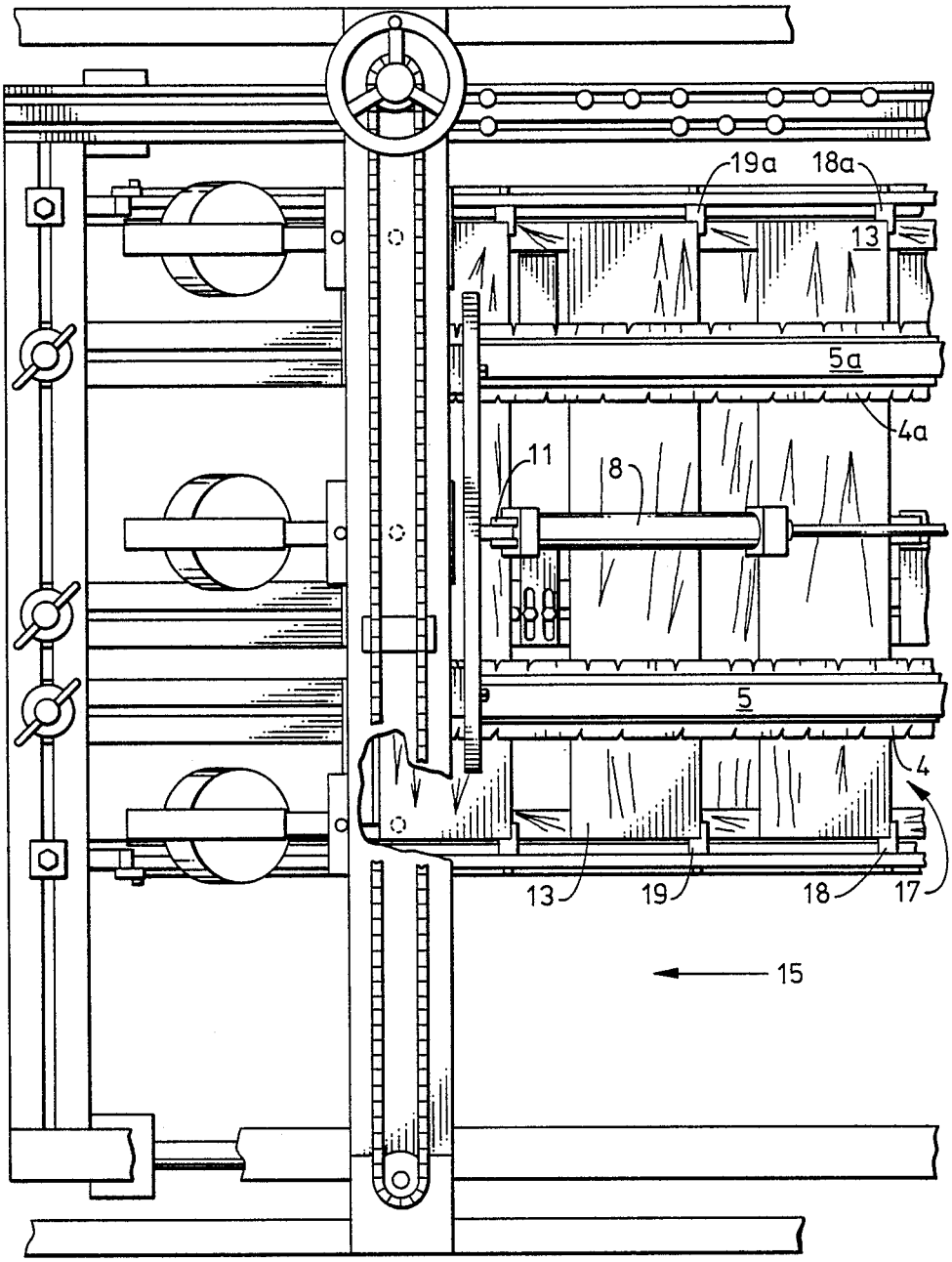
FIG. 6 is a top view of the alignment bed portion of a pallet building system showing a hold-down clamp of the present invention.

FIG. 4 is a top plan view of the alignment bed of a pallet building machine used in accordance with the present invention. This view shows the alignment bed 14 containing the jig system which aligns the pallet pieces into their final position in preparation for assembly into a finished pallet. FIG. 4 specifically shows the cooperation of trailing jig pieces 17 with top pallet slat pieces 13. The hold-down clamp assembly of the present invention helps to maintain top pallet slat pieces against their respective trailing jig pieces by providing a frictional counterforce thereto. The hold-down clamp assembly of the present invention also serves to dampen vibration from the transport system and from the firing of the nailing tools so as to prevent dislodgement of the pallet pieces from their final position as the assembly process is carried out.

The position of the nailing tools and tool mounts of the present invention can be appreciated generally from FIGS. 1 and 2. FIG. 2 particularly shows that the upper tool mount 40 positions the top nailing tool 41 above the nailing position 16 while lower tool mount 43 positions the bottom nailing tool 44 below nailing position 16. Both tool mounts are held in position by attachment to the frame of the pallet building machine. Upper tool mount 40 is attached to horizontal support member 9 while lower tool mount 43 is attached to horizontal support member 9*a*.

The upper tool mount 40 supports top nailing tool 41 while allowing it to oscillate vertically as the unattached pallet pieces are passed beneath its muzzle 45. This is facilitated in the displayed embodiment by the mechanical arrangement displayed in FIG. 9. FIG. 9 shows attachment plate 46 which is vertically slidably attached to mounting plate 47 in this case by bolt 48 attached to attachment plate 46 and passing through control slot 49. Bolt 48 is further fitted with hand nut 50 which may be unscrewed to demount the attachment plate/nailing tool assembly. Nailing tools 41 and 44 are attached to attachment plates 46 and 68, respectively, by attachment bolts 22 and 23, respectively. FIG. 9 also shows that the attachment plate 46 can have attached to its upper end lower control plate 51 which, together with upper horizontal control plate 52, cooperates to contain vertical counterspring 53 (not shown in FIG. 9 but rather in FIG. 8) which serves to counter the vertical movement of the top nailing tool 41. Top nailing tool 41 moves in response to the action of alignment wheel 54 as it rolls over the top surface of top slats 13 as the unassembled pallet pieces, held in their final position, are passed by nailing position 16 beneath tool guide body 45. The bottom of vertical alignment wheel 54 is adjusted so as to be slightly beneath the end of nailing tool guide body 45. This allows the nailing tool guide body 45 to consistently reside in a position just slightly above the top surface of the top pallet slats 13 so as to permit the top nailing tool(s) to accommodate surface irregularities in the top pallet slats 13. The combination of the vertical alignment wheel, and the vertical moveability of the nailing tool in the inventive tool mount, together with counterspring 53, makes possible the accommodation of surface irregularities to prevent the machine from jamming while maintaining the nailing tool guide body at a predetermined distance above the top surface of the top pallet slats to make possible the control of the depth to which nails are placed in the pallet pieces. This is important because nails placed too deep may eventually cause the nail to be pulled through the slat piece causing the slat piece to become partially or wholly detached. Conversely, nails placed too shallow may cause cargo to be caught upon, and potentially injured by, the protruding nail head.

Figure 8:
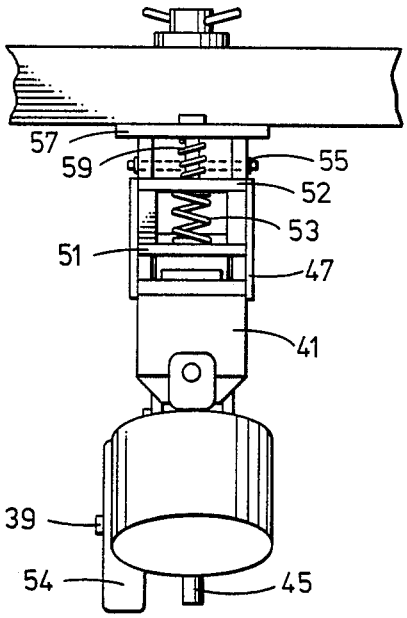
FIG. 8 is an elevational view of the tool mount of the present invention viewed in the upstream direction.
Figure 9:
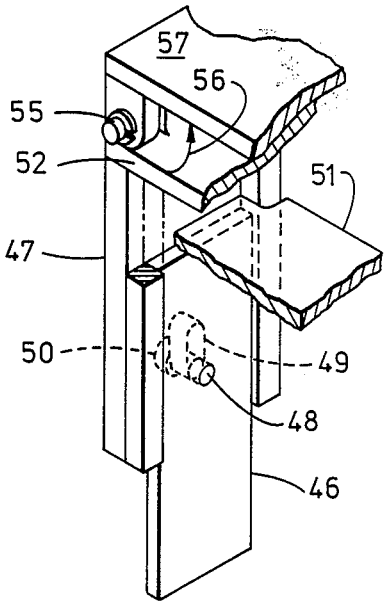
FIG. 9 is a partial cross-sectional view of the floating dual plate portion of the tool mount viewed at approximately a 45° angle to the upstream direction.

Another feature of the inventive tool mount of the present invention can be seen in FIGS. 8 and 9. To provide an additional direction of movement for the nailing tool, i.e., a slight downstream movement of the nailing tool guide body, the upper control plate 52 can be further fitted with swivel hinge 55 which allows upper control plate 52 to swivel in direction 56 with respect to uppermost base plate 57. It is preferred that spring means such as spring 58 is interposed between upper control plate 52 and uppermost base plate 57 so as to provide counterforce against the swivel movement of the nailing tool in the tool mount.

As nailing tool 41 is fired, it is allowed to move vertically within the freedom allowed by the slide bolt 48 within the vertical slot 49. This vertical movement is controlled and dampened by tool mount spring 53 which constantly urges alignment wheel 54 against the surface of the uppermost pallet piece 13 as the pallet pieces are moved in the downstream direction 15 by nailing station 16. The vertical alignment wheel 54 is attached to the mount extension 38 which is in turn attached to attachment plate 46 via mounting bracket 37.

This additional direction of movement also permits the tool guide body 45 to be resilient to obstructions and surface irregularities it may encounter which are not otherwise avoided by the vertical movement of the nailing tool. For instance, the ability of the nailing tool guide body to swivel slightly downstream permits the nailing tool to free itself from an obstruction such as a misplaced nail without causing the pallet building machine to jam. Another beneficial effect of the downstream swiveling is that upper control plate 52 swivels upward in direction 56 as each nail is fired in conservation of momentum. This allows the nailing tool to place the nail more precisely in the moving pallet because the downstream swivel of the nailing tool follows the pallet's movement. Another positive effect of both the downstream swivel and vertical movement of the nailing tool, with corresponding respective counterforce supplied by the vertical and swivel countersprings, is the dampening of vibration which would otherwise be transmitted throughout the pallet building machine.

Because the lower tool mounts holding the bottom nailing tools do not have the vertical alignment problems attendant to the top nailing tools (because gravity tends to align the bottom pallet slats with respect to bottom nailing tool guide body 60 seen in FIGS. 2 and 3), it is not necessary to incorporate the vertical alignment wheel as done for the upper tool mount. Gross vertical adjustment of horizontal support member 9*a* is done by hand wheel 61 as seen in FIG. 3. Likewise, gross vertical adjustments of horizontal support member 9 can be made by the action of hand wheel 62 also shown in FIG. 3. The bottom tool mounts do, however, incorporate means for providing downstream swivel of the bottom nailing tool guide body 60 by the use of a lower swivel hinge 63 interposed between lower control plate 64 and lower base plate 65. Also interposed between lower base plate 65 and lower control plate 64 is the lower swivel counterspring 66 which maintains muzzle 60 of bottom nailing tool 44 in a vertical position and returns the guide body 60 after each firing of bottom nailing tool 44. The ability of the bottom nailing tool to swivel downstream allows the nailing tool to avoid being caught by obstructions which can cause the pallet machine to jam, while facilitating proper positioning of the nail in the passing bottom pallet slat as the unattached pallet pieces are passed by the nailing position 16.

As can be appreciated from FIG. 3, the lower tool mount assembly does provide for vertical movement of the nailing tool in the same fashion as the top nailing tool mount. In this regard, mounting plate 67 and attachment plate 68 are attached by bolt 69 in the same fashion as shown for attachment plate 46 and mounting plate 47 in FIG. 9. This arrangement can also be appreciated from FIG. 3. Also similar to the arrangement of the top tool mount, the vertical movement of the bottom nailing tool is controlled by vertical counterforce spring 70.

The dampening material may be made of suitable natural or synthetic materials. Where the dampening material is a brush, the fibers may be made of suitably stiff and resilient natural fibers such as hemp or animal hair, or various synthetic polymeric fibers such as nylon. Where the dampening material is other than a brush, it may be a material such as sponge, soft rubber or other material having sufficiently similar resilient characteristics. It is preferred that the dampening material be a brush of natural or synthetic fibers.

The present invention may also be applied to other applications where the use of staples or nails are required to be placed in a longitudinally extending structure. For example, similar structures may be assembled by the use of staples instead of nails through the use of appropriate industrial stapling tools. Other assemblies to which the present assembly might be applied is in the construction of such longitudinal assemblies as fencing or latticework to which the continuous construction of longitudinal assemblies could be applied.

In view of the foregoing disclosure, it will be apparent to one of ordinary skill in the art to make variations in the invention without departing from its spirit.

What is claimed is:

1. Apparatus for assembling a longitudinal pallet assembly comprising top and bottom pieces attached directly or indirectly to each other, comprising:

(a) a fixture for receiving the top and bottom pieces of the assembly in substantially the final position they will occupy in the longitudinal assembly, (b) means for transporting the top and bottom pieces of the assembly to at least one attachment means, (c) means for placing a dampening material comprising a longitudinally extending brush-like structure against the top and bottom pieces of the assembly whereby the top and bottom pieces are held in the final position as they are transported longitudinally toward at least one attachment means, and (d) at least one embodiment means for attaching the top and bottom pieces of the assembly into a finished longitudinal assembly.

2. The apparatus according to claim 1 wherein said dampening material extends substantially across the top pieces while the top pieces are in said fixture and up to a point just upstream from said at least one attachment means whereby the top and bottom pieces are held in their final position up to a point just before being attached into said final position.

3. The apparatus according to claim 1 wherein said dampening material comprises a series of longitudinally extending, substantially parallel brush-like structures.

4. The apparatus according to claim 1 wherein said dampening material is movable between an upper position wherein said dampening material is not in contact with the top pieces in said fixture, to a lower position wherein said dampening material is in firm and resilient contact with the top pieces in said fixture.

5. The apparatus according to claim 4 wherein the top pieces are held slidably within the fibers of said brush-like structure when said brush-like structure is in said lower position.

6. Apparatus for assembling a pallet comprising top and bottom pieces attached directly or indirectly to each other, comprising:

(a) a fixture for receiving the top and bottom pieces of the pallet in substantially the final position they will occupy in the pallet, (b) means for transporting the top and bottom pieces of the pallet to at least one attachment means, (c) at least one attachment means for attaching the top and bottom pieces to the pallet hingedly mounted upon said apparatus such that during activation of said attachment means said at least one attachment means in simultaneously capable of moving vertically and rotating only in the downstream direction, and (d) means for placing a resilient longitudinally extending brush-like structure against the top and bottom pieces of the pallet such that they are held in the final position as said fixture is transported longitudinally toward said at least one attachment means.

7. The apparatus according to claim 6 comprising at least two attachment means, at least one attachment means firing downward from above the top and bottom pieces of assembly and at least one attachment means firing up from below the top and bottom pieces.

8. The apparatus according to claim 6 wherein said at least one attachment means is positioned so as to fire down from above the top and bottom pieces of said assembly and further comprising means for maintaining the delivering end of said attachment means a substantially constant distance above the surface into which said attachment means fires.

9. The apparatus according to claim 8 wherein said means for maintaining a substantially constant distance above the surface into which said attachment means fires is a substantially vertically aligned wheel attached to said attachment means and which extends below the delivery end of said attachment means.

* * * * *

UNITED STATES PATENT AND TRADEMARK OFFICE

CERTIFICATE OF CORRECTION

PATENT NO. : 4,967,948

DATED : November 6, 1990

INVENTOR(S) : Scott N. Allspaw

It is certified that error appears in the above-identified patent and that said Letters Patent is hereby corrected as shown below:

Column 8, line 3: delete "embodiment" and substitute therefor: --attachment--

Signed and Sealed this

Twenty-third Day of June, 1992

*Attest:*

DOUGLAS B. COMER

*Attesting Officer*

*Acting Commissioner of Patents and Trademarks*